United States Patent [19]

Bannister

[11] 4,444,240

[45] Apr. 24, 1984

[54] FOLDABLE DEVICE

[75] Inventor: Brian C. Bannister, North Mymms, England

[73] Assignee: Marler Haley Exposystems Ltd., Barnet, England

[21] Appl. No.: 394,768

[22] Filed: Jul. 2, 1982

[30] Foreign Application Priority Data

Jul. 6, 1981 [GB] United Kingdom ..... 8120852

[51] Int. Cl.[3] ..... E06B 3/48

[52] U.S. Cl. ..... 160/135; 160/229 R

[58] Field of Search ..... 160/229 R, 135, 377, 160/251, 331, 332, 3; 40/605, 610; 52/70, 71

[56] References Cited

U.S. PATENT DOCUMENTS

| | | | |
|---|---|---|---|
| 1,661,003 | 2/1928 | Miller | 160/135 |
| 1,915,504 | 6/1933 | Stokby | 160/351 |
| 4,030,219 | 6/1977 | Donovan | 40/605 |
| 4,063,585 | 12/1977 | Stanley | 160/135 |
| 4,194,313 | 3/1980 | Downing | 160/135 |
| 4,232,488 | 11/1980 | Hanley | 52/71 |

FOREIGN PATENT DOCUMENTS

| | | | |
|---|---|---|---|
| 1248636 | 11/1960 | France | 52/71 |
| 638425 | 4/1962 | Italy | 52/71 |
| 365860 | 1/1963 | Switzerland | 160/206 |
| 671765 | 5/1952 | United Kingdom . | |
| 1185011 | 5/1970 | United Kingdom . | |
| 1316431 | 5/1973 | United Kingdom . | |
| 1542244 | 3/1974 | United Kingdom | 52/71 |
| 1353593 | 5/1974 | United Kingdom . | |
| 1492615 | 11/1977 | United Kingdom . | |

*Primary Examiner*—Peter M. Caun
*Assistant Examiner*—Cherney S. Lieberman
*Attorney, Agent, or Firm*—Parmelee, Miller, Welsh & Kratz

[57] ABSTRACT

A foldable device is disclosed, particularly suitable for presenting exhibition displays or the like, which comprises a plurality of generally rectangular planar members, pivotally connected end-to-end in such a way that, in a folded condition of the device, the planar members lie in face to face engagement with one another. The pivotal connection between any two pivotally connected planar members comprises connecting members each pivotally connected with both the planar members for pivoting about respective axes co-planar with the planar members, and inter-meshing gear segments carried on the planar members and concentric with the respective axes.

9 Claims, 15 Drawing Figures

FOLDABLE DEVICE

FIELD OF THE INVENTION

This invention relates to foldable devices and is particularly, but not exclusively, applicable to a portable display device, for example for use by salesmen or in exhibition displays etc.

BACKGROUND OF THE INVENTION

Display devices for such purposes are known which comprise "lazy-tong" arrangements, which are intended to be folded up compactly for transportation. However, the known devices are awkward to use and are quite unstable, and for these and other reasons have met with little success in practice.

SUMMARY OF THE INVENTION

It is an object of the present invention to provide an improved foldable device.

According to one aspect of the invention, there is provided a foldable device comprising a plurality of members each pivotally connected end to end in series in such a way that the device can be folded up compactly and can readily be unfolded into an erected condition, means being provided for maintaining desired relative positions of the members in said erected position, each of said members being substantially flat and planar as herein defined, in the sense of having surface portions thereof lying in respective ones of a pair of spaced apart parallel planes, the extent of each said planar member, in mutually perpendicular directions parallel with the respective pair of planes, being substantially greater than the spacing between said planes, the axes of the pivotal connections between adjoining said planar members being substantially parallel with said planes of the two planar members, the pivotal connection between each pair of adjacent planar members being effected by at least one connecting member pivotally connected with one of the planar members for pivoting about one axis and pivotally connected with the adjacent planar member for pivoting about a parallel, transversely spaced axis, whereby in the folded condition of the device the planar members can lie in face to face engagement with one another.

The term "planar member" as used herein is intended to extend to members which, for example, comprise a plurality of pivotally or otherwise movably inter-connected sub-members, such that said sub-members can be moved between relative positions, occupied in the folded condition of the device, in which the member formed by said sub-members is planar in the sense referred to, and relative positions in which the member formed by the sub-members is, for example, bent at an angle at a position intermediate its ends.

The phrase "being substantially flat and planar" when applied to a said member is intended to extend to "planar members" as defined above, which are planar in the folded condition of the device even if they are not necessarily so in an erected position of the device.

Embodiments of the invention are described below by way of example with reference to the accompanying drawings.

DESCRIPTION OF PREFERRED EMBODIMENTS

Figure 1:
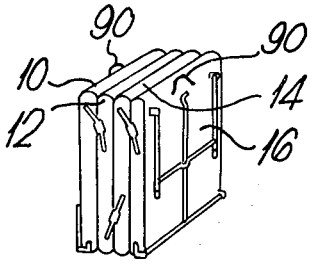
FIGS. 1(*a*), (*b*), (*c*) and (*d*) are schematic perspective views showing successive stages in the erection and/or folding up of a display device embodying the invention.
Figure 1B:
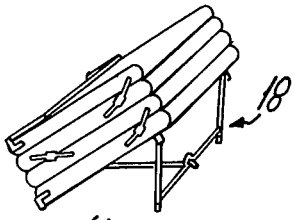
Figure 1C:
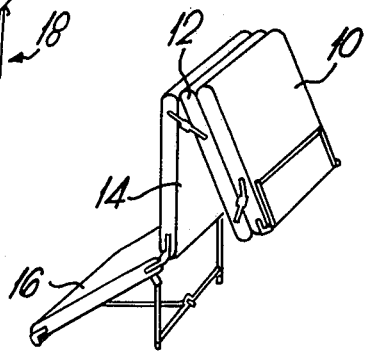
Figure 1D:
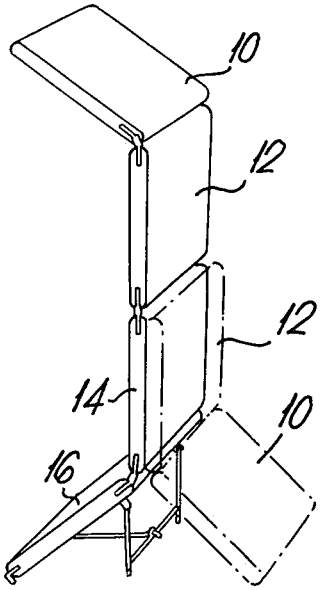

Referring to FIG. 1, the display device illustrated comprises four identically dimensioned rectangular panels 10, 12, 14 and 16 respectively which are pivotally connected end to end in series, in such a way that the device can be folded up compactly, to the form shown in FIG. 1(*a*), in accordian fashion. Thus, in relation to the orientation shown in FIG. 1(*a*), the upper end of the panel 10 is pivotally connected to the upper end of the panel 12, the lower end of the panel 12 is pivotally connected to the lower end of the panel 14 and the upper end of the panel 14 is pivotally connected to the upper end of the panel 16.

As will become apparent, the pivotal connection between each pair of adjacent panels is effected by intervening connecting members pivotally connected with the panels in such a way that, despite the substantial thickness of the panels, they can be folded with their major faces flat against one another as shown in FIG. 1(*a*).

The panel 16 carries, on the face which is outermost in the folded condition of FIG. 1(*a*), a folding stand structure indicated generally at 18 which, in an erected position, as shown in FIGS. 1(*b*), (*c*) and (*d*), is capable of supporting the device from the foor or ground with the panel 16 inclined, and the pivotal connection between panels 14 and 16 disposed adjacent the upper end of the panel 16. Thus, from the condition shown in FIG. 1(*a*), the stand structure 18 can readily be unfolded, and the device placed in the condition shown in FIG. 1(*b*), in which the panels 12 to 16 are still each flat against the other. The panels 10, 12 and 14 can then be folded upwardly from the panel 16, the panels 10 and 12 being then swung upwardly from the panel 14, the panels 10 and 12 swung upwardly from the panel 14, then the panel 10 swung upwardly away from the now vertical panel 12, as shown in FIGS. 1(*b*) to 1(*d*) to place the device in the condition shown in full lines in FIG. 1(*d*). The pivot arrangements between the panels include locking devices whereby each panel, after it has been swung into the appropriate position (as shown in FIG. 1(*d*)) relative to an adjoining panel is locked in that position relative to said adjoining panel by releasable catch means. Thus the device is stable in the position shown in FIG. 1(*d*). The device is also capable of adopting an alternative configuration in which, as indicated by dotted lines in FIG. 1(*d*), the panel 12 remains folded flat against the panel 14, while the panel 10 is inclined downwardly from the panel 12 to ground level.

Figure 6:
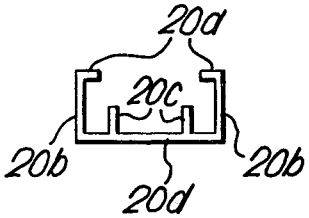
FIG. 6 is a sectional view of an edge strip of a panel of the device.

Each panel 10 to 16 has secured to each of its two parallel longitudinal edges a respective strip of channel section, for example a length of aluminium extrusion, of the cross-section shown in FIG. 6, i.e. having the form of a rectangular channel with inturned flanges 20*a* on the side walls 20*b* of the the channel at the mouth of the channel and with two transversely spaced longitudinal ribs 20*c* extending within the channel from the base 20*d* of the channel. Each channel section strip 29 is secured to the respective edge of the respective panel with its base in engagement with the respective edge face of the panel and its side walls substantially coplanar with the respective major faces of the panel.

Figure 3A:
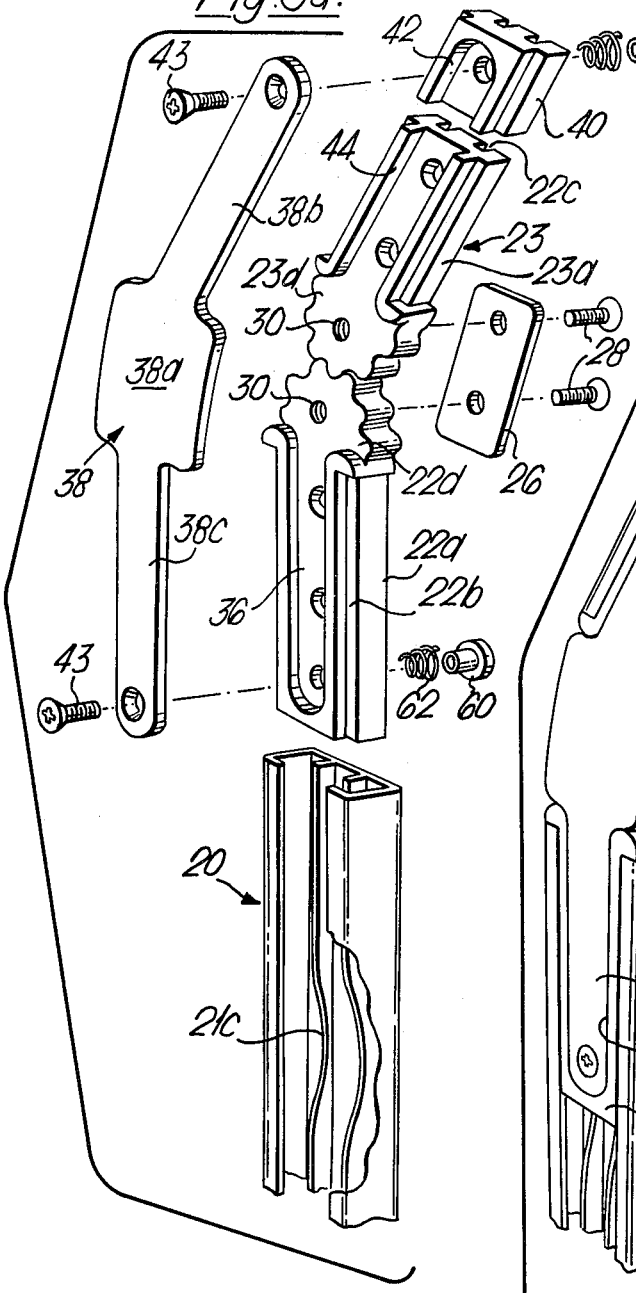

By way of example, the pivotal connection between panels 10 and 12 will now be described with reference to FIGS. 3(*a*) and (*b*). The pivotal connection between the adjoining panels 10 and 12 is effected by connecting means including a respective insert 22, inserted in the respective end of each of the strips 20 of the panel 12, and a respective insert 23 inserted in the respective end of each of the strips 20 of the panel 10. The inserts 22, 23 include respective body parts 22*a* and 23*a* which have each a cross sectional shape substantially complementary with that of the channel section strips 20, incorporating rebates 22*b* to receive the flanges 20*a* of the respective strips 20 and longitudinal grooves 22*c* to receive the upstanding ribs 20*c* in the respective strip. Each insert 22 and 23 also includes, integral with the body part 22*a*, 23*a* a respective part 22*d*, 23 *d* which is formed as an arcuate gear segment having an axis perpendicular with the longitudinal axis of the respective strip 20 and parallel with the major faces of the respective panel. Each insert 22, 23 is fixed with respect to its strip 20 and the respective panel by screws passed through countersunk holes in the respective insert 22, 23, through the base 20*d* of the respective strip 20 and into the respective panel. The gear segment 22*d* of each insert 22 meshes with the adjoining gear segment 23*d* of the adjoining insert 23 as shown in FIG. 3(*a*) and the adjoining, interengaged inserts 22 and 23 are connected by a respective plate 26 formed with two apertures through which are passed screws 28 engaged in screw threaded bores 30 formed through the respective gear segments 22*d*, each screw 28 being coaxial with the respective gear segment 22*d* in which it is engaged, the screws 28 providing pivotal connections between the plate 26 and the inserts 22, 23. Thus, the two panels pivotally connected by the arrangement of FIGS. 3(*a*) and 3(*b*) can be subjected to a swinging movement one relative to the other, in the course of which movement the respective gear segments 22*d* of one panel effectively roll in mesh with the respective segments 23*d* of the adjoining panel so that each panel pivots with respect to the plate 26 about a respective axis parallel with the respective end edge of the panel and coincident with the axis of the bores 30 of the respective pair of inserts 22 or 23, said axis constituting the respective said rotary axis of the respective gear segments, the plates 26 pivoting with respect to the two panels at half the rate of angular movement of the one panel relative to the other. If preferred, of course, rivets or loose pins may be used instead of the screws 28.

Figure 4:
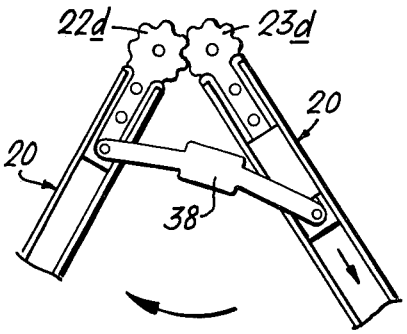
FIG. 4 is a diagrammatic elevational view showing the operation of the mechanism illustrated in FIGS. 3(*a*) and 3(*b*)

It will be appreciated that this arrangement allows the panels 10 and 12 to be folded, through the position shown in FIG. 4, into a position in which they lie flat against one another, and yet to adopt, in the unfolded condition, a relative position as if the panels were connected by a single pivot having its axis extending along the intersection of those planes, parallel with the major faces, of the two panels which enclose the axes of the respective gear segments and which extend parallel with the major faces of the two panels.

FIGS. 3(*a*) and 3(*b*) also illustrate the catch arrangement by means of which the two panels, 10 and 12, having been moved to their desired position, are locked in position relative to one another. Each insert 22 has, on its face which is presented outwardly through the mouth of the respective channel-section strip 20, an elongate recess 36, the outwardly presented faces of the adjoining segment portion 22*d* being cut back to the level of the bottom of the recess 36. Disposed in the respective strip 20, adjacent the end of each insert 23 which is further from the gear segment 23*d* thereof, is a respective sliding block 40 which has a cross-sectional shape corresponding to that of insert 23. The insert 23 and block 40 have, in fact, substantially the same form as would result from dividing an insert 22 in two along a parting plane adjacent the end of the insert 22 remote from the respective gear segment 22*d*. Thus, the insert 23 has a recess 44 which is open at the end of the insert remote from the respective gear segment 23*d*, while the block 40 has a recess 42 similar to the closed end of the recess 36 in the insert 22 and formed as a continuation of the recess 44 in insert 23. The block 40 can slide longitudinally along the respective strip 20 away from the insert 23 when the panels 10 and 12 are folded together, whilst being held slidingly captive in the respective strip 20.

Figure 3B:
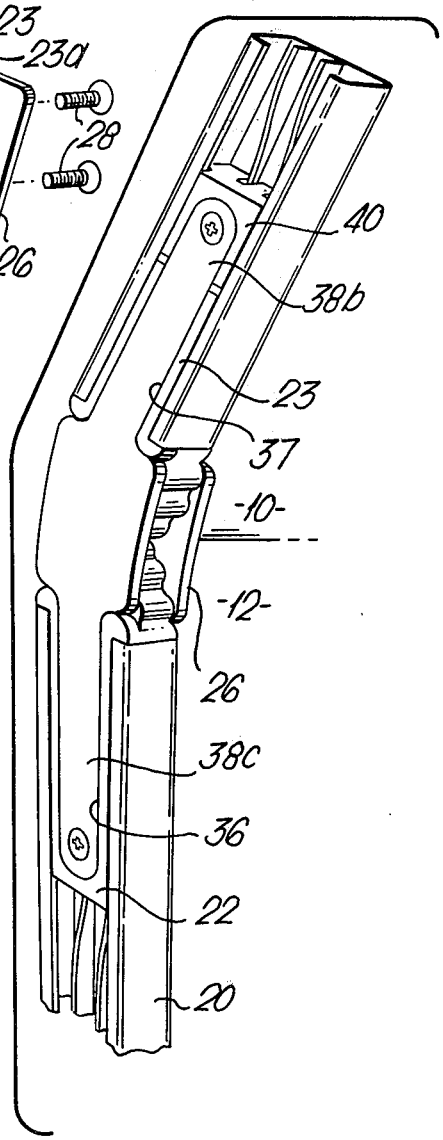

A flat metal plate 38 is provided having a central portion 38*a*, from opposite ends of which extend elongate arms 38*b*, the plate 38 being so dimensioned that, in the erected position of the device as shown in FIG. 3*b*, the arm 38*c* fits snugly in the recess 36 in the insert 22, and the arm 38*b* fits snugly in the recesses 44 and 42 in the insert 23, and block 40 with the central portion 38 fitting closely between the body parts of the two inserts 22, 23 with one face thereof lying closely against the outwardly presented faces of the segments 22*d*, 23*d*. The plate 38, when so engaged, thus prevents relative pivotal movement between the panels 10 and 12. The plate 38 is pivotally connected, by screws 43 extended through respective holes in the free ends of the arms 38*c* and 38*b*, to the insert 22 and the sliding block 40 respectively.

Figure 7:
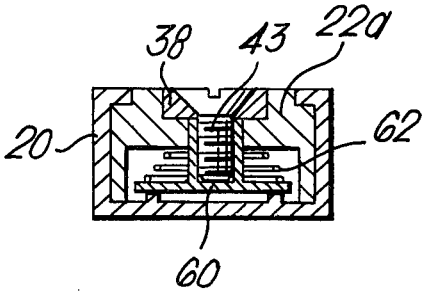
FIG. 7 is a sectional view showing a detail of the assembly of FIGS. 3(*a*) and 3(*b*)

In order for folding of the panels 10 and 12 together to be possible, it is necessary to displace the plate 38 is a whole outwardly from the edges of the panels, in a direction parallel with the rotary axes of the segments 22*d* so that the arms 38*b*, 38*c* clear the recesses 36, 44, 42. To this end, the screws 43 are not screwed directly into the insert 22 and block 40, but instead are screwed into respective flanged collars 60, each having a cylindrical tubular portion, receiving the screw shank, and which extends freely through a corresponding bore in the outer wall of the insert 22 or block 40 and having a flange extending radially outwardly from the cylindrical tubular portion, at the end of the latter remote from the plate 38. Each member 60 is held against the respective arm 38*b*, 38*c* by the respective screw 43 and a respective compression spring 62 is held in a compressed condition between the flange of each member 60 and the inner face of the outer wall of the corresponding insert 22 or block 40, as shown in FIG. 7. Each spring 62 is accommodated in a respective recess formed on the inner side of the respective inset 22 or block 40. The springs 62 thus tend to draw the plate 38 inwardly into engagement with the recesses 36, 42, but the plate 38 can be drawn outwardly against the springs 62 to allow relative pivoting of the panels in the manner described. During such pivotal movement, the cylindrical parts of the members 60 act as journals of the plate 38, while the block 40 slides longitudinally along its strips 20, away from the adjoining insert 23, as indicated in FIG. 4, so as to permit such folding of the panels.

Figure 2:
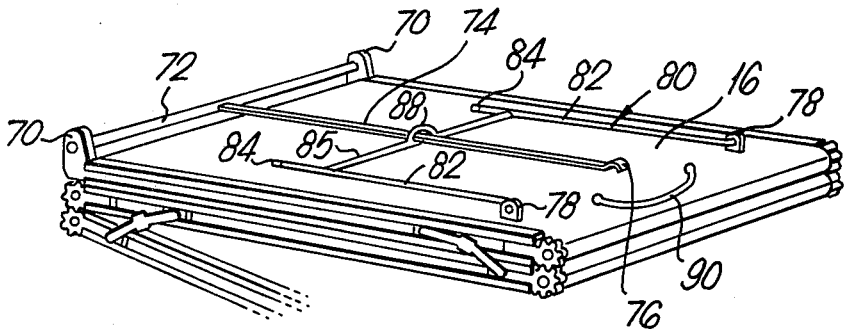
FIG. 2 is a fragmentary perspective view showing part of the device of FIG. 1 to a larger scale, FIG. 3(*a*) is an exploded perspective view of a detail of the device showing the hinge arrangement between adjacent panels, FIG. 3(*b*) is view corresponding to FIG. 3(*a*) but showing the components in an assembled condition.

The pivotal connections between the other panels take the same form, except that in the case of the pivotal connection between the panels 12 and 14, plates are used which differ from the plate 38 in that the longitudinal axes of the two arms of each plate, instead of being inclined with respect to one another, as in the plate 38, are coincident. Thus the plates, corresponding to plates 38, of the pivotal connection between the panels 12 and 14, when engaged in the respective recesses, hold the panels 12 and 14 in a substantially coplanar disposition as shown in FIG. 1(*d*). In general, of course, the plates corresponding to plates 38, used in the connection between any two adjoining panels may be formed with any desired angle between the longitudinal axes of the two arms of each plate, provided, of course that the two plates in each said connection match one another. As indicated in FIGS. 1 and 2, the adjoining ends of the panels 12 to 16 may, if desired, have rounded edges, i.e. edge surfaces which are arcuate about the axes of the respective pairs of geared segments 22*d*, 23*d*, to allow pivotal movement of the panels relative to one another while minimising any gap between adjoining panels. This feature is, of course, not always necessary.

Each of the panels 10 preferably comprises two planar boards secured together face to face, each board being covered on one major face and its edges by a respective piece of felt, baize or the like fabric, the edges of said piece of fabric being secured to the major face of the respective board which lies against the corresponding major face of the other board, so that said edges of said pieces of fabric are concealed and reliably secured between the boards making up the panels. The device in this form is particularly suited for use in conjunction with displays and accessories having mounting patches of hooked pile fabric such as that sold under the Registered Trade Mark "Velcro". If desired, one or more of the panels may be provided with inset sockets for lamps or other electrical fittings and with connecting means whereby electrical circuitry within one or more of the panels, for supplying such fitments, may be connected to a mains outlet.

Referring to FIG. 2, at the end of the panel 16 which is not connected with the panel 14, the ends of the strips 20 receive insert members 70, each of which includes a portion having a shape complementary to the interior of the rail section, and, projecting therefrom, a lug pivotally supporting a respective end of a transverse bar 72 extending between the lugs, whereby the bar 72 can be rotated about its axis, parallel with the adjacent end of the panel 16, in the lugs. Extending from the mid-point of the bar 72 at right angles thereto is a strut member 74, welded at one end to the bar 72 and carrying at its other end a hook member 76.

The folding stand structure 18 includes, extending from that face of the panel 16 which, in the folded condition of the device, faces outwardly, and which faces downwardly in the erected position of the device, two brackets 78 disposed adjacent the respective strips 20 of the panel 16, adjacent the end of the panel 16 remote from the bar 72. Pivotally mounted in the brackets 78 is a frame, indicated generally at 80, and also forming a part of the folding stand structure 18. The frame 80 comprising two parallel side members 82, each having one end thereof pivotally connected to a respective bracket and carrying a foot 84 at its the opposite end. The limbs 82 are connected by a transverse spar 85 extending between the limbs 82 perpendicular with, and secured to, the limbs 82. In the erected state of the stand structure 18, the hook member 76 is clipped over the spar 85 to brace the frame 80, while in the folded condition of the frame 18, as shown in FIG. 2, the hook member 76 is disengaged from the spar 85 and the strut 74 overlaps the spar 85. Preferably a guide fitment 88 is provided which connects the strut 74 slidably with the spar 85, to hold the strut 74 neatly against the spar 85, with the spars 74 and 82 lying parallel with and close to the adjoining face of the panel 16, in the folded condition of the device.

The device is preferably provided with carrying handles, indicated schematically at 90, which may, for example, be secured to the faces of the panels 10, 16 which lie face outwardly in the folded condition of the device, e.g. adjacent the upper ends of the panels as viewed in FIG. 1(*a*). Alternatively, the device may be provided with a convenient carrying case (not shown) into which the device may be fitted for transportation, and if desired the case may itself form part of the device in the erected position, for example part of the folding stand structure 18.

One or more of the panels 10 to 16 may be provided with an ancillary fitting or fittings each capable of being moved between a stowed position in which it lies within the confines of the panel, and an operational position defining, in or on the erected device, one or more pockets, shelves, or the like.

Figure 5:
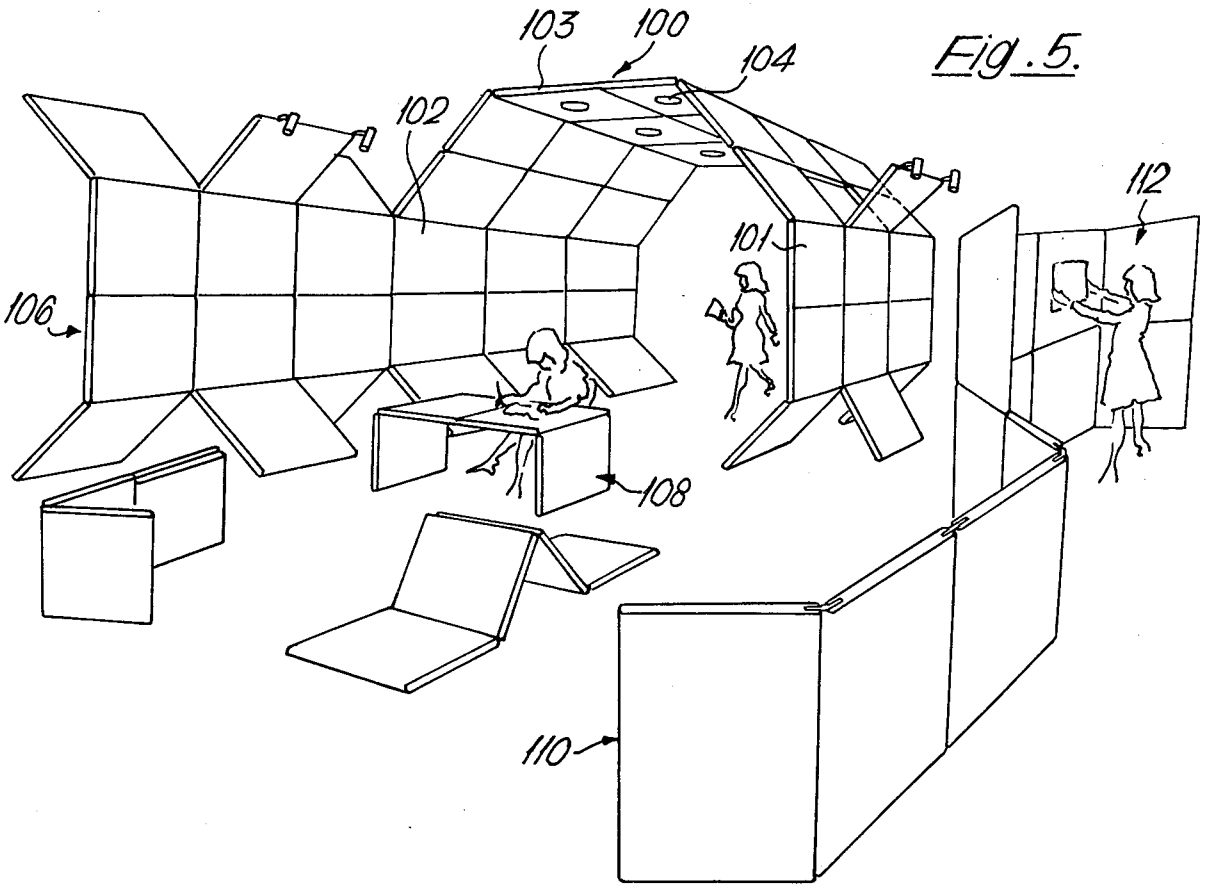
FIG. 5 is a perspective view illustrating an exhibition structure and associated structures formed using a plurality of the devices of FIGS. 1 to 4.

By providing, at the free edges of the panels 10 and 16, attachment means whereby either of said free edges may be releasably connected with a corresponding free edge of an identical device, three devices of the kind described may be fitted together to form an arch, as indicated at 105 in FIG. 5, with two oppositely facing devices 101 and 102 disposed on the floor in the erected condition and a third such device 103 spanning the devices 102 and 101. Such a configuration is useful in temporary exhibition displays and the like. As shown, a plurality of such arches may be disposed end to end to form a tunnel or arcade, with lighting fixtures, indicated at 104, being carried by the panels 12 and 14 of the devices 103. A series of folding display devices of the kind described may also be arranged, as indicated generally at 106, to form a temporary wall or extended strip of panelling for display purposes. As will be noted, there is no necessity, in such an arrangement, for all of the devices to face in precisely the same way and the devices may be arranged alternately as shown.

A display device of the kind shown in the drawings may also be arranged, for example, as a table, as indicated at 108, or may be laid on its side to provide a bay as indicated at 110. If desired, attachment means (not shown) may be provided whereby adjoining devices may be connected side by side or, where laid on their sides, stacked upon one another to form a bay of extended height as indicated at 112.

It will be appreciated that while, in the embodiment described, each of the panels 10 to 16 is in the form of a substantially continuous planar slab, any one or more of these panels may take the form of, or be replaced by, a planar member of some other form, i.e. a member which, although not necessarily in the form of a continuous slab, has oppositely facing surface portions thereof lying in respective ones of a pair of spaced apart parallel planes, with the extent of the planar member, in mutually perpendicular directions parallel with said planes, being substantially greater than the spacing between said planes. In other words, the length and width dimensions of the planar member are substantially greater than its thickness. Thus a said planar member may comprise a rectangular frame having the sides thereof extending parallel with said planes of the member and bounding a rectangular opening through the member. Such a frame may be left open, or may be clad with sheet material on one or both sides, or have an insert of sheet material. Where such sheet material is used in conjunction with the frame it may be translucent or transparent so that the planar member may serve as a window, for example in a composite structure comprising a plurality of the devices. In such a case, if desired, a blind, e.g. a roller blind, may be fitted in the frame.

Similarly a said planar member may take the form of a flat box, one major face of the planar member being formed, or partly formed, by a lid of the box.

Apart from constructions utilising rectangular frames, any said panel may be formed with apertures therethrough, or recesses therein, which are of any desired shape.

Any said panel or planar member may be a unitary, e.g. moulded member, which may, if desired, be of plastics material, e.g transparent plastics.

While the panels have been described as covered or lined with fabric, panels may be utilised which are unlined or are covered with any desired material.

In the embodiment described with reference to FIGS. 1 to 7, successive panels in the series fold in alternate directions relative to the preceding panels, so that the device folds up in zig-zag or "accordian" fashion. However, if desired, successive panels may fold in the same direction relative to the preceding panels. The device described with reference to the drawings incorporates a plurality of rectangular panels which are similarly dimensioned. While this is a desirable feature in a portable display device, in other applications this feature is less important. Thus, for example, a folding table may comprise an elongate rectangular central panel with respective shorter panels pivotally connected to opposite ends thereof, the shorter panels being capable of being folded onto the same major face of the central panel in the folded condition, the table, in the erected position, taking substantially the same general form as indicated at 108 in FIG. 5.

A variant folding device is shown in FIGS. 8 to 15. In this device, instead of the substantially uniform-thickness panels of the embodiment of the preceding figures, planar members are utilised, each of wich comprises a rectangular peripheral frame 200 within which may be fitted a panel of sheet material, not shown in FIG. 8 but indicated at 202 in FIG. 9, each planar member relying upon its peripheral frame 200 for its rigidity. Each frame 200 is preferably formed from a continuous length of a hollow aluminium extrusion, bent to the desired rectangular shape, to afford, in each frame 200, two opposing, parallel longitudinal limbs 201 and two transverse limbs 203 at opposite ends, connecting the ends of the longitudinal limbs 201.

Figure 8:
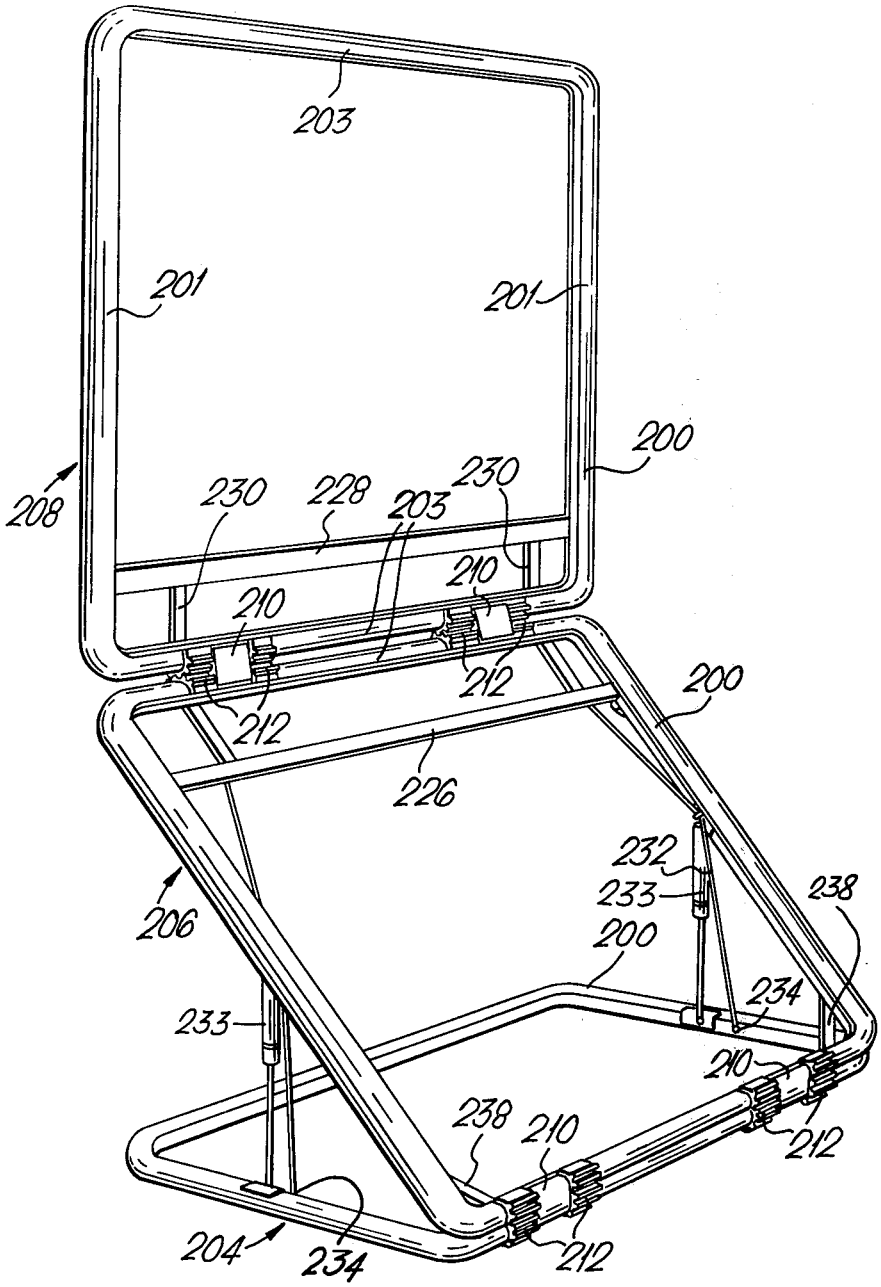
FIG. 8 is a perspective view of a device forming another embodiment of the invention, in an erected state.

In the device shown in FIG. 8, three planar members, 204, 206 and 208 respectively are pivotally connected end to end for relative pivotal movement about respective axes parallel with the transverse limbs of the respective frames.

As in the embodiment of FIGS. 1 to 7, the pivotal connection between each pair of adjacent planar members is effected by a pair of connecting members each pivotally connected with each of the respective two planar members, each said pivotal connection further comprising a set of intermeshing gear teeth carried by the respective members. In the embodiment of FIG. 8, the connecting members take the form of sheet-metal clips 210 of elongated C-section, (see FIG. 14) each hooked over the parallel adjoining transverse limbs of the respective adjoining frames, and the gear teeth are provided by serrated profiled members 212 fitted over the respective transverse limbs.

Figure 15:
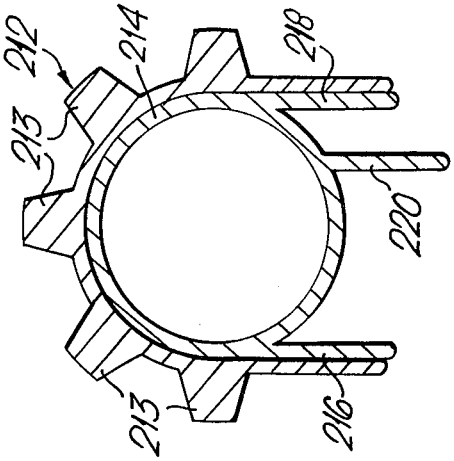
FIG. 15 is a view in section along the line A—A of FIG. 14.
Figure 14:
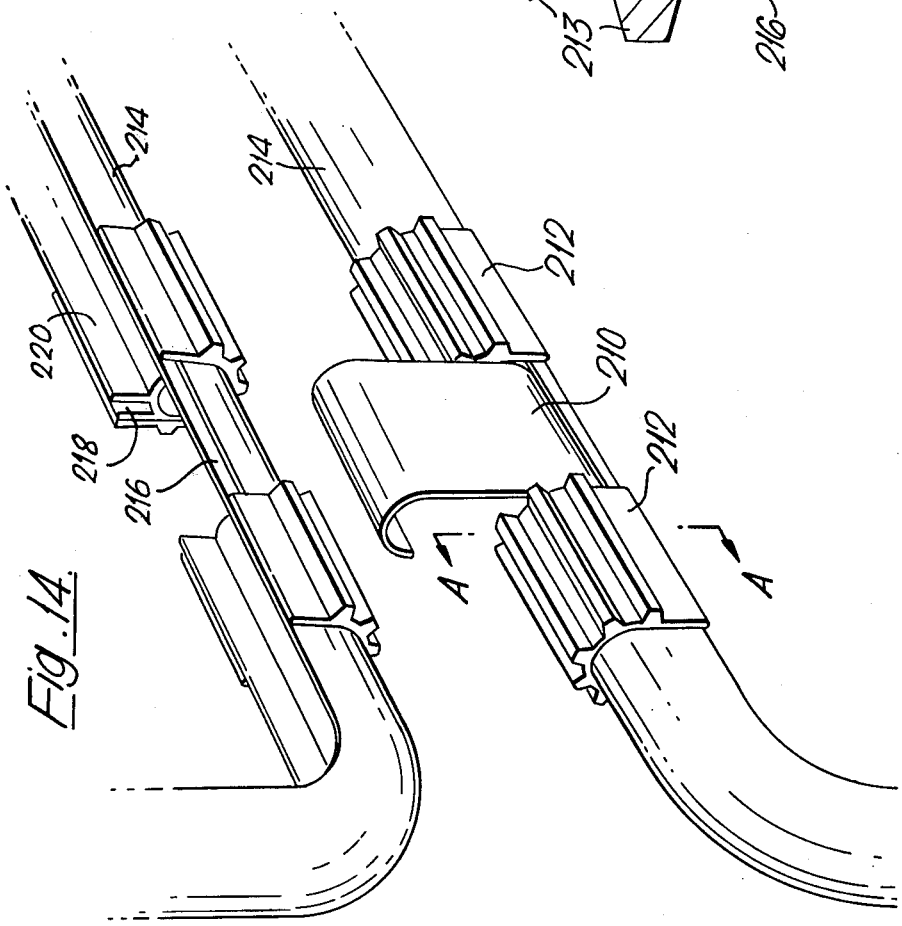
FIG. 14 is a detail, partly exploded, view of a hinge structure incorporated in the device of FIG. 8.

Considered in more detail, and referring to FIG. 15, the extrusion forming the frames 200 has the form of a cylindrical tubular portion 214 with integral planar flanges extending therefrom, the flanges lying in parallel planes and comprising flanges 216 and 218 extending tangentially with respect to the tubular portion 214, on opposite sides of the latter, and a further flange 220 disposed intermediate the flanges 216 and 218 but located closer to the flange 218 than the flange 216. In forming the frames 200, the extrusion is bent so that the flanges 216 to 220 lie on the inside of the rectangular frame, with the planes of the flanges being parallel with the plane of the resulting frame. The material of the extrusion and the relative dimensions of the tubular portion and the flanges is selected so as to allow the frames to be formed in the configuration shown by bending the extrusion without buckling of the flanges in the region of the bends.

Each of the members 212 is in the form of a length cut from an extrusion of the cross-section shown in FIG. 15 and comprising a U-shaped body with longitudinally extending ribs 213, forming the gear teeth, extending on the outside of the extrusion over the rounded portion of the bend of the U. As also shown in FIG. 15, each member 212 is fitted over the tubing with the arms of the U lying against the respective flanges 216, 218. The members 212 are preferably of a resiliently deformable plastics material, or of an elastomeric material.

As shown in FIG. 8, the pivotal connection between any pair of adjoining frames 200 comprises two members 210 spaced apart longitudinally along the respective transverse limbs of the respective frames, a respective pair of intermeshing gear members 212 being disposed on either side of each member 210. The flanges 216 to 220 are cut away in the region of each member 210, FIG. 14, to allow passage of the member 210 the flanges either being removed entirely so that the respective portion of each frame limb is of simple cylindrical form, or simply over the regions immediately adjoining the tubular portion of the extrusion, by forming respective longitudinal slots through the flanges in this region. It will normally be necessary to cut away entirely the flanges 218 and 220 over the respective area while the remaining flange 216 may be merely slotted, in order to conserve rigidity in the respective frame.

Figure 12:
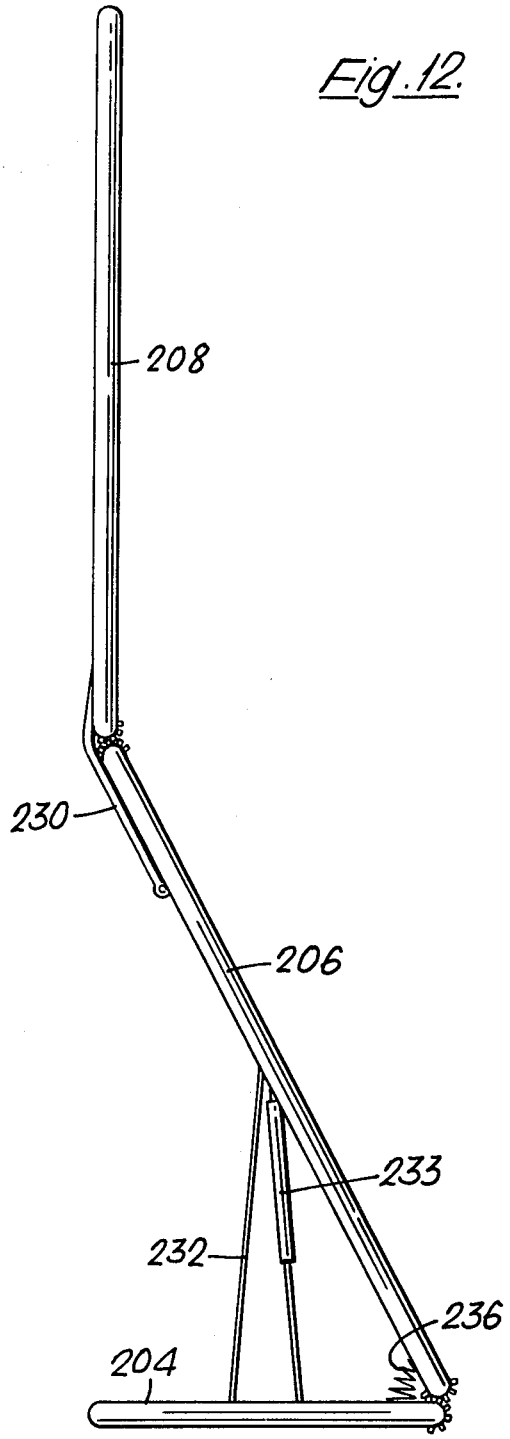
FIG. 12 is a side elevation view of the device of FIG. 8 in the erected state.

As best shown in FIG. 8, the frame 206 has, adjacent its pivotal junction with the frame 208, a transversely extending spar 226, for example of square-section steel tubing, secured at either end to the frame 206 parallel with the transverse limbs. A corresponding transverse spar 228 is secured across the frame 208, also adjacent the pivotal connection with the frame 206 and parallel with the transverse limbs and has, fixed thereto, two arms 230 extending at right angles to the strut 228, each arm 230 comprising a first portion extending from the spar 228 towards the adjacent transverse limb of the frame 208 generally parallel with the plane of the frame 208, and a further portion, bent at an obtuse angle with respect to the first portion, extending from the first portion to the free end of the respective arm, the bend in each arm 230 being located so as to be disposed substantially in the region of the pivotal connection between the frames 206 and 208 in the erected condition of the structure, in which, as shown in FIGS. 8 and 12, the free ends of the arms 230 bear against the spar 226. Connected to the free end of each arm 230 is a respective cord 232, which is led through guide means on the frame 206 to an anchoring point 234 on the frame 204, on the respective longitudinal limb of the frame 204 which is disposed on the same side of the structure as the respective arm 230, the point 234 being spaced somewhat from the pivotal connection between the frame 204 and the frame 206. The guide means may be an eyelet or the like carried by the frame 206, or, alternatively, the cord 232 may be arranged to pass for some distance along the interior of the respective longitudinal limb of the frame 206, through apertures in the latter.

At each side of the structure a respective pneumatic or hydraulic damper 233 is connected between the respective longitudinal limb of the frame 206 and the respective longitudinal limb of the frame 204. Furthermore, on each side of the structure, a respective spring 236 acts between the frames 204 and 206 to urge the latter to the angularly separated position shown in FIGS. 8 and 12. In the arrangement shown, each spring 236 acts between a plate 238 extended across the respective corner of frame 206 adjacent the pivotal connection between frames 206 and 204, and a pair of corresponding plates (not shown) extended across the adjacent corners of the frame 204, functioning in the manner depicted in FIG. 12. Alternatively, compression springs may be incorporated in the respective dampers 233.

Figure 11:
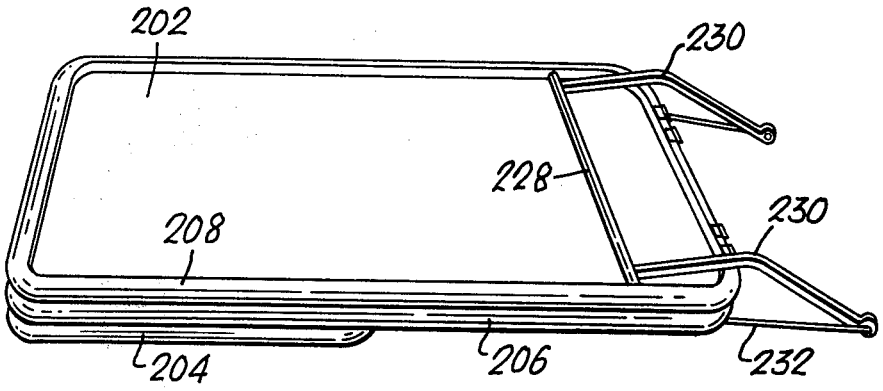
FIG. 11 is a perspective view of the device of FIG. 8 in a folded condition.
Figure 13:
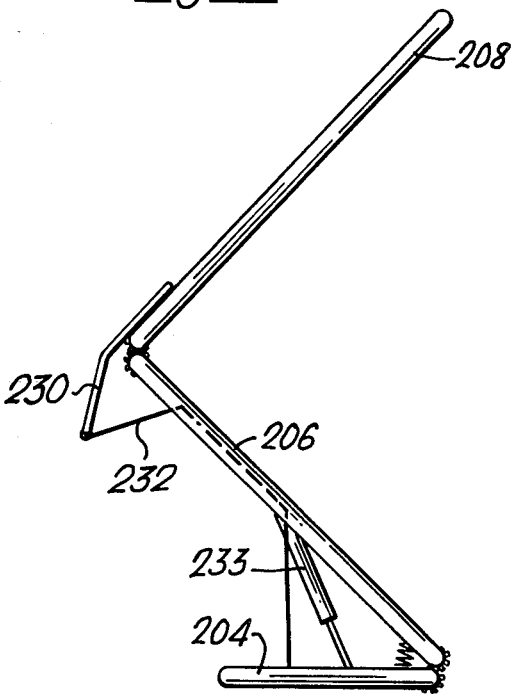
FIG. 13 is a side elevation view of the device of FIGS. 8, 11 and 12 at a point during movement between its erected and its folded states.

The arrangement described allows the structure to be opened from a folded condition, shown in FIG. 11, to the erected position, shown in FIGS. 8 and 12, simply by releasing retaining means (not shown) provided to retain the structure in the folded condition, whereupon the action of the springs 236 urges the frames 204 and 206 apart pivotally which, in turn, via the cords 232 and the arms 230, causes the frame 208 to be swung upwardly away from the frame 206, the dampers 233 ensuring that the opening movement takes place relatively slowly and in a controlled manner. If desired, the strength of the springs 236 may be so selected as to just counterbalance the weight of the structure, so that the structure will not open of its own accord but will require the minimum of external applied force in order to move it to its open position.

The frames 206 and 208, at least, are normally filled by respective rectangular panels 202 which may conveniently be secured to one or other of the flanges 216 to 220. These panels may bear advertising, display or the like material or may be arranged to provide a support for such material.

Figure 9:
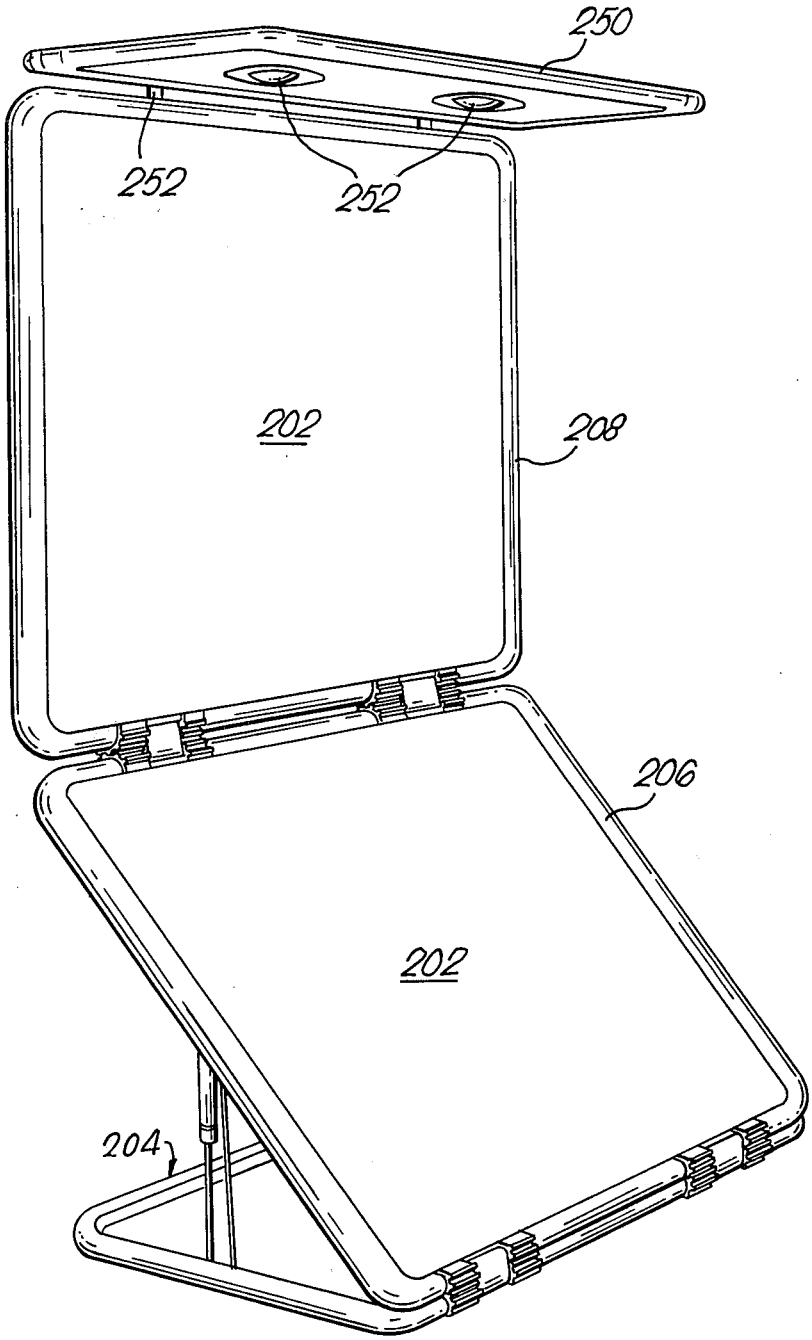
FIGS. 9 and 10 are perspective views of the embodiment of FIG. 8 with respective optional additional components.
Figure 10:
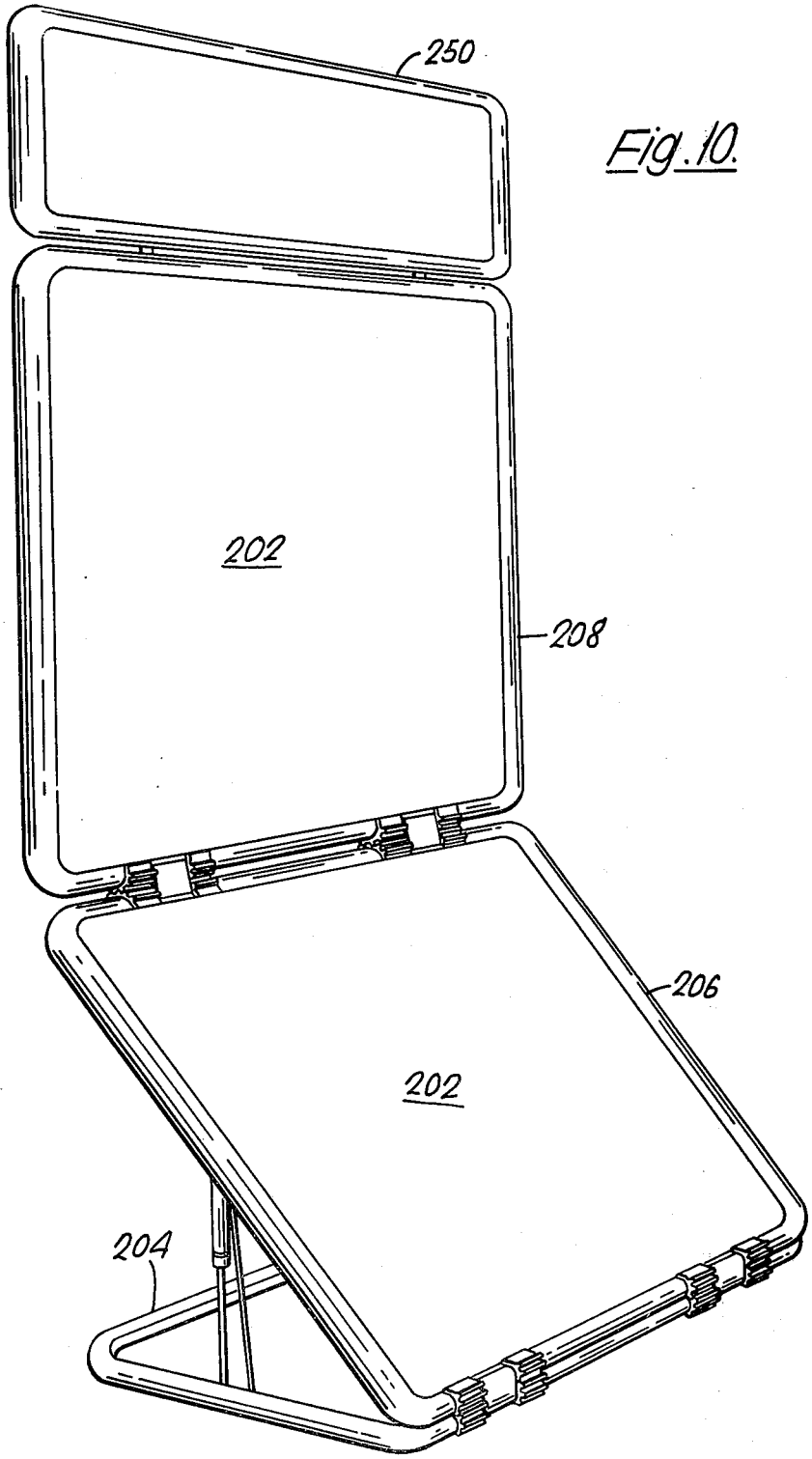

As shown in FIGS. 9 and 10, a further frame 250, formed of the same material as the frames 204, 206 and 208, and of the same transverse dimensions as the latter, but substantially shorter than these, may be provided, detachably connectable with the frame 208 by means of joints 252. The joints 252, (not shown in detail) each comprise conventional, preformed clips or clamps secured to the frames 208 and 250, and preferably the components are detachably mounted on the respective frames and interchangeable with alternative such components so that the frame 250 may be secured to the frame 208 either co-planar therewith and extending upwardly therefrom, or inclined with respect to the plane of the frame 208 at an angle, for example at 30° or 60°, or disposed at 90° to the frame 208 as shown in FIG. 9. The last noted arrangement of the frame 250 is particularly suited to the case in which the frame 250 and/or the panel fitted therein, provides a support for light 253 for illuminating the material carried by the frames 206, 208. As with the structure of FIGS. 1 to 7, the structure of FIGS. 8 to 15 may be arranged adjacent similar structures, (and if desired may be detachably connected therewith), to form extended partitioning or the like structures for use, for example, in exhibitions.

While the pivotal connections between adjoining panels in the embodiments described with reference to the drawings incorporate interengaging geared segments, it will be appreciated that the use of such geared segments is not essential and that simpler hinge or pivot arrangements may be quite adequate in some variants.

Whilst, in the devices described, the planar members each comprising a frame 200 with its respective panel of sheet material, are rigid, if desired one or more of such planar members may comprise two or more sub-members, for example respective planar frames with respective planar panels therein, with the sub-members being, for example pivotally connected end to end for relative pivotal movement about transverse axes, so that each such composite member can be laid flat to form a truly planar member in the previously stated sense, when the device is to be folded up, or can be bent, by relative articulation of the sub-members, in the erected position of the device, so that in this position the respective member may be, for example, of angled form.

I claim:

1. A foldable device comprising a plurality of planar members having ends, means pivotally connecting said members end to end in series whereby the device can be folded up compactly and can readily be unfolded into an erected condition, means for maintaining desired relative positions of the members in said erected position, said means pivotally connecting said planar members together including, for each pair of adjacent planar members, a connecting member, means pivotally connecting said connecting member with one of the planar members of the pair for pivoting about one axis parallel with said planes and means pivotally connecting said connecting member with the adjacent planar member for pivoting about a further axis, parallel with, and spaced transversely from said one axis, all of said axes being parallel with one another whereby in the folded condition of the device the planar members can lie in face to face engagement with one another, and wherein said means for maintaining said desired relative positions of said planar members in the erected condition includes spring means which, at least in said erected condition of the device, acts to urge at least two adjoining planar members apart, and means for limiting such movement of said members apart to a predetermined extent.

2. A foldable device comprising a plurality of generally flat, planar members each having opposite parallel ends and opposite sides extending between said ends, means pivotally connecting said members end to end in series with said ends parallel with one another whereby the device can be folded up compactly and can readily be unfolded into an erected condition, means for maintaining desired relative positions of the members in said erected condition, said means pivotally connecting said members together comprising, for each pair of adjoining said members, at least one connecting member, means pivotally connecting the connecting member with one of the generally flat planar members for pivoting about one axis parallel with said ends, and means pivotally connecting said connecting member with the other said planar member for pivoting about another axis parallel with said ends and spaced transversely from said one axis, and wherein said means for maintaining said desired relative positions of said members in the erected condition includes spring means which, at least in said erected condition of the device, acts to urge at least two adjoining planar members apart, and means for limiting such movement of said members apart to a predetermined extent.

3. The device of claim 2 wherein said planar members are rectangular in shape and said means for limiting movement of said rectangular planar members apart comprises a flexible cord.

4. The device of claim 3 which includes at least three successive rectangular planar members and wherein said cord is arranged to connect at least said three successive planar members and serves to limit relative movement of two of said members so connected with respect to the other.

5. The device of claim 4 wherein said three successive, generally flat rectangular planar members include a first said member, a second said member adjoining said first member, and a third said member adjoining said second member, the device including guide means on said second member and a lever part carried by said third member and wherein said spring means is arranged to urge pivotally apart said first and second members, and wherein said cord is fixed at one end to a point on said first member, passing slidably through said guide means on said second member and secured to a point on said lever part carried by said third member, the arrangement being such that as said first and second members are urged apart by said spring means, the cord is drawn out between them and consequently said lever part is drawn towards the respective guide means on said second member, thereby moving the second and third members pivotally apart also.

6. The device of claim 2 wherein said plurality of generally flat planar members are similarly dimensioned, the pivotal connections between the planar members being such that the device can be folded up compactly, in accordion fashion.

7. The device of claim 2 wherein, in each pair of adjacent, pivotally connected planar members, each member carries an array of gear teeth meshing with a said array of gear teeth of the other member of the pair, the arrangement being such that, by virtue of the meshing engagement of said gear teeth, during relative pivotal movement of the members of the pair, the adjoining ends of said planar members roll around one another.

8. The device of claim 7, wherein each said generally flat, planar member comprises a peripheral frame providing the respective said ends and sides, wherein the respective gear teeth are formed on arcuate members fitted around the respective ends of said frames, and the respective connecting members extend around the respective ends of said frames.

9. The device of claim 8 wherein the respective said end of each said peripheral frame in the region of the respective pivotal connection comprises a round-section tube or bar and each said connecting member has an open hook or bend at either end engaged around the respective round-section tube or bar.

* * * * *